US007520210B2

(12) United States Patent
Theodore, Jr. et al.

(10) Patent No.: US 7,520,210 B2
(45) Date of Patent: Apr. 21, 2009

(54) OIL SEPARATOR FOR A FLUID DISPLACEMENT APPARATUS

(75) Inventors: Michael Gregory Theodore, Jr., Plymouth, MI (US); Brian Kelm, Plymouth, MI (US); Alfred Lim Poy, Livonia, MI (US); Yong Huang, Northville, MI (US); Kanwal Bhatia, Troy, MI (US)

(73) Assignee: Visteon Global Technologies, Inc., Van Buren Township, MI (US)

( * ) Notice: Subject to any disclaimer, the term of this patent is extended or adjusted under 35 U.S.C. 154(b) by 157 days.

(21) Appl. No.: 11/528,035

(22) Filed: Sep. 27, 2006

(65) Prior Publication Data

US 2008/0072750 A1 Mar. 27, 2008

(51) Int. Cl.
*F01B 3/00* (2006.01)
*F01B 31/10* (2006.01)
*F04B 27/08* (2006.01)

(52) U.S. Cl. ..... 92/71; 92/154; 417/269

(58) Field of Classification Search ..... 91/499; 92/57, 71, 153, 154; 184/6.17; 417/269
See application file for complete search history.

(56) References Cited

U.S. PATENT DOCUMENTS

| | | | | |
|---|---|---|---|---|
| 3,778,984 | A | | 12/1973 | Lawser |
| 4,221,544 | A | * | 9/1980 | Ohta ..... 417/269 |
| 4,392,788 | A | | 7/1983 | Nakamura et al. |
| 4,583,922 | A | | 4/1986 | Iijima et al. |
| 5,733,107 | A | | 3/1998 | Ideda et al. |
| 6,149,398 | A | | 11/2000 | Fukanuma et al. |
| 6,206,648 | B1 | | 3/2001 | Kimura et al. |
| 6,481,240 | B2 | | 11/2002 | Strikis et al. |
| 6,497,114 | B1 | | 12/2002 | Strikis et al. |
| 6,511,297 | B2 | | 1/2003 | Ota et al. |
| 6,551,072 | B2 | | 4/2003 | Ota et al. |
| 6,558,133 | B2 | | 5/2003 | Fukanuma et al. |
| 2003/0210989 | A1 | | 11/2003 | Matsuoka et al. |
| 2004/0005223 | A1 | | 1/2004 | Kawachi et al. |
| 2004/0028534 | A1 | | 2/2004 | Hinrichs |

FOREIGN PATENT DOCUMENTS

| | | |
|---|---|---|
| DE | 198 00 556 A1 | 8/1998 |
| EP | 0 334 634 A1 | 9/1989 |
| EP | 0 926 341 A2 | 6/1999 |
| EP | 0 943 802 A2 | 9/1999 |
| EP | 0 965 804 B1 | 12/1999 |
| EP | 1 143 145 A2 | 10/2001 |
| EP | 1 160 448 A1 | 12/2001 |
| EP | 1 160 449 A1 | 12/2001 |
| EP | 1 164 290 A2 | 12/2001 |
| EP | 1 167 763 A2 | 1/2002 |
| EP | 1 431 087 A2 | 6/2004 |
| EP | 1 508 695 A1 | 2/2005 |
| EP | 1 217 215 B1 | 3/2005 |
| EP | 1 302 665 B1 | 3/2005 |

(Continued)

*Primary Examiner*—Michael Leslie
(74) *Attorney, Agent, or Firm*—Fraser Clemens Martin & Miller LLC; J. Douglas Miller

(57) ABSTRACT

An oil separator for a compressor is shown, wherein an oil separating efficiency is maximized and a material cost, a weight, and an assembly time are minimized.

17 Claims, 3 Drawing Sheets

FOREIGN PATENT DOCUMENTS

| | | | |
|---|---|---|---|
| EP | 1 365 153 | B1 | 4/2005 |
| EP | 1 167 762 | B1 | 9/2005 |
| EP | 1 609 989 | A2 | 12/2005 |
| WO | WO 01/36823 | A1 | 5/2001 |
| WO | WO 01/42657 | A1 | 6/2001 |
| WO | WO 2005/066492 | A1 | 7/2005 |
| WO | WO 2005/108881 | A1 | 11/2005 |
| WO | WO 2005/111417 | A1 | 11/2005 |
| WO | WO 2008/001965 | A1 | 1/2008 |

* cited by examiner

OIL SEPARATOR FOR A FLUID DISPLACEMENT APPARATUS

FIELD OF THE INVENTION

The present invention relates to an oil separator and more particularly to an oil separator for a fluid displacement apparatus wherein oil separation capabilities are maximized.

BACKGROUND OF THE INVENTION

Compressors used in refrigeration and air conditioning systems such as swashplate type compressors, for example, typically include a lubricating oil mist suspended in a gaseous refrigerant medium. Such compressors also include a first path that provides refrigerant communication between the crank chamber and the discharge chamber, and a second path that provides refrigerant communication between the crank chamber and the suction chamber.

During operation of the compressor, the oil mist lubricates the moving parts of the compressor. However, oil that remains suspended in the refrigerant as it travels throughout the refrigeration circuit can reduce the performance of the refrigeration circuit. Also, by reducing oil available to the moving parts of the compressor, the compressor is susceptible to increased wear and seizure potential.

To combat these problems, an oil separator can be added to the refrigeration circuit. Such an oil separator is typically positioned between the compressor outlet and a condenser inlet. The oil separator functions to separate the suspended oil from the gaseous refrigerant, so that the oil is maintained in the compressor and not introduced into the suction chamber.

It would be desirable to produce an oil separator wherein an oil separation efficiency thereof is maximized and a cost of manufacture, a weight, and an assembly time thereof are minimized.

SUMMARY OF THE INVENTION

Harmonious with the present invention, an oil separator wherein an oil separation efficiency thereof is maximized and a cost of manufacture, a weight, and an assembly time thereof are minimized has surprisingly been discovered.

In one embodiment, an oil separator for a compressor comprises: a drive shaft including a passageway formed therein, the passageway in communication with a suction chamber of the compressor; and a rotation imparting structure disposed on the drive shaft having a passageway formed therein, the passageway in communication with a crank chamber of the compressor and with the passageway formed in the drive shaft to provide fluid communication between the crank chamber of the compressor and the suction chamber of the compressor.

In another embodiment, a compressor comprises: a head including a suction chamber formed therein; a crank case including a crank chamber formed therein; a cylinder block disposed between the head and the crank case, the cylinder block having a plurality of pistons reciprocatingly disposed therein; a drive shaft rotatingly disposed in the crank chamber and having a passageway formed therein, the passageway in fluid communication with the suction chamber; and a rotation imparting structure disposed on the drive shaft and having a passageway formed therein, the passageway in fluid communication with the crank chamber and with the passageway formed in the drive shaft to provide fluid communication between the crank chamber and the suction chamber.

A method for separating oil from a second fluid in a compressor is disclosed, wherein the method comprises the steps of: providing a drive shaft adapted to be disposed in a crank chamber, the drive shaft having a first aperture formed on an outer surface thereof and a passageway formed in an inner portion thereof, the first aperture in fluid communication with the passageway; providing a rotation imparting structure adapted to be disposed on the drive shaft, the rotation imparting structure having a first aperture formed on an outer surface thereof and a passageway formed in an inner portion thereof, the passageway in fluid communication with the passageway formed in the drive shaft; causing a mixture of fluid to enter the rotation imparting structure; and causing the drive shaft and the rotation imparting structure to rotate about an axis of rotation to cause a separation of the mixture of fluid by a centrifugal force.

BRIEF DESCRIPTION OF THE DRAWINGS

The above, as well as other objects and advantages of the invention, will become readily apparent to those skilled in the art from reading the following detailed description of a preferred embodiment of the invention when considered in the light of the accompanying drawings in which.

DETAILED DESCRIPTION OF THE PREFERRED EMBODIMENT

The following detailed description and appended drawings describe and illustrate various exemplary embodiments of the invention. The description and drawings serve to enable one skilled in the art to make and use the invention, and are not intended to limit the scope of the invention in any manner. In respect of the methods disclosed and illustrated, the steps presented are exemplary in nature, and thus, the order of the steps is not necessary or critical.

Figure 1:
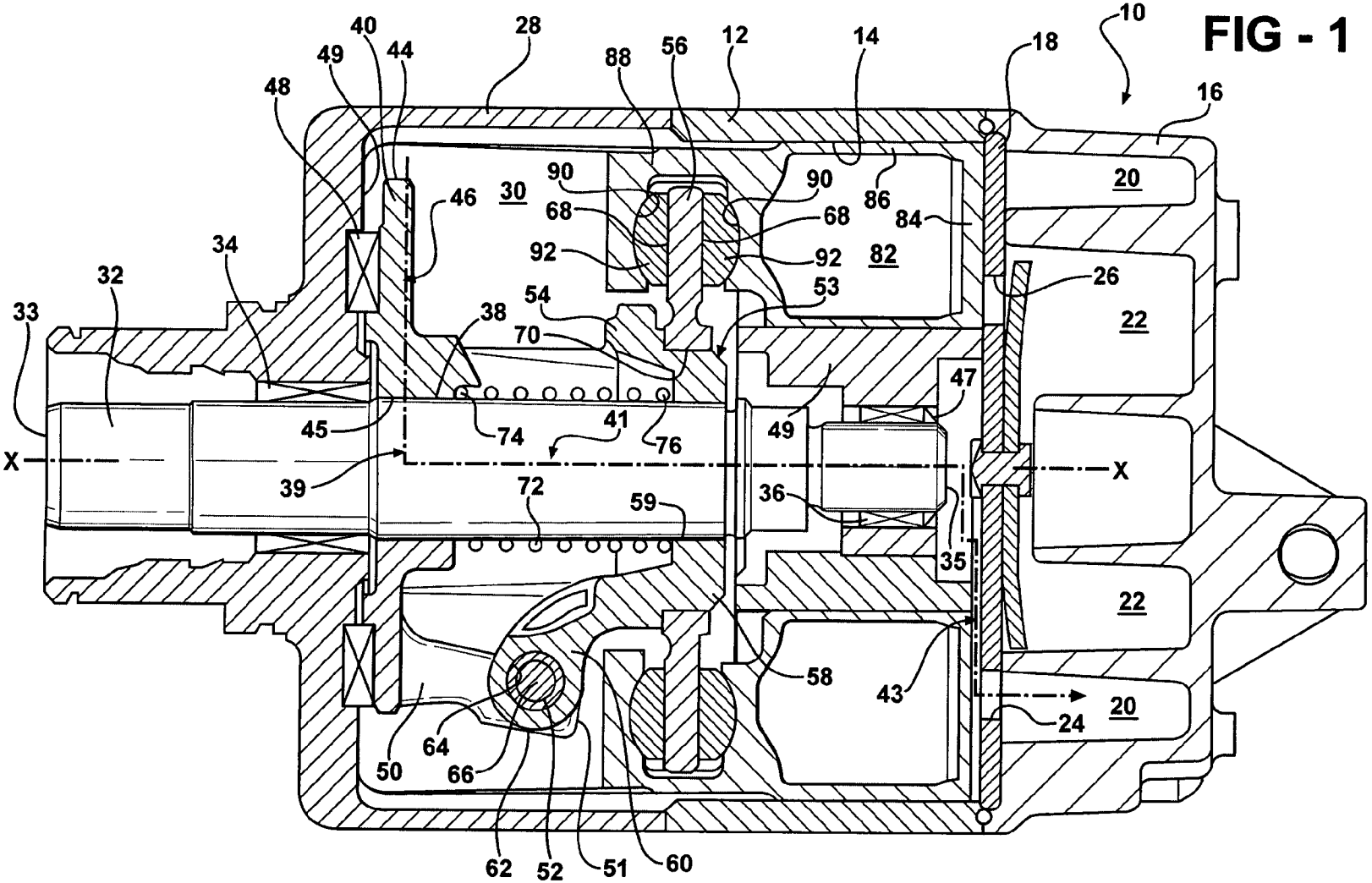
FIG. 1 shows a sectional view of a variable displacement swash plate-type compressor illustrating a flow path in accordance with an embodiment of the invention.

FIG. 1 shows a variable displacement swash plate-type compressor 10 in accordance with an embodiment of the invention. The compressor 10 includes a cylinder block 12 having a plurality of cylinders 14 formed therein. A head 16 is disposed adjacent one end of the cylinder block 12 and sealingly closes the end of the cylinder block 12. A valve plate 18 is disposed between the cylinder block 12 and the head 16. The head 16 includes a suction chamber 20 and a discharge chamber 22. The suction chamber 20 communicates with the cylinders 14 through a suction port 24 formed in the valve plate 18. The cylinders 14 communicate with the discharge chamber 22 through a discharge port 26 formed in the valve plate 18. A crankcase 28 is sealingly disposed at the other end of the cylinder block 12. The crankcase 28 and cylinder block 12 cooperate to form an airtight crank chamber 30.

A drive shaft 32 having a first end 33 and a second end 35 is centrally disposed in and extends through the crankcase 28 to the cylinder block 12. The drive shaft 32 is rotatably supported by a bearing 34 mounted in the crankcase 28 and a bearing 36 mounted in the cylinder block 12. A radially outwardly extending passageway 39 and an axially outwardly extending passageway 41 are formed in the drive shaft 32. It is understood that additional radially outwardly extending passageways (not shown) can be formed in the drive shaft 32 and connected to the axially outwardly extending passageway 41 as desired, such as an array of radially outwardly extending passageways, for example. The radially outwardly extending passageway 39 and the axially outwardly extending passageway 41 cooperate to form a fluid passageway from a radial outer surface 38 of the drive shaft 32 to the second end 35 of the drive shaft.

A fluid passageway 43 is formed in the cylinder block 12 and provides fluid communication between the fluid passageway formed in the drive shaft 32 and the suction port 24. A seal 47 is sealingly engaged to the drive shaft 32 and a drive shaft support bore 49. Such a seal is disclosed in U.S. Pat. No. 6,942,465, herein incorporated by reference in its entirety.

A rotor 40 is mounted within the crank chamber 30 on the drive shaft 32. Rotor, as used herein, is meant to include rotation imparting structures such as a swash plate, a swash ring, a wobble plate, a thrust disc, an extension of the drive shaft, and the like, for example. The rotor 40 includes a fluid passageway 46 formed therein. It is understood that additional fluid passageways can be formed in the rotor 40 or additional rotors disposed on the drive shaft 32 as desired. The fluid passageway 46 extends from a centrally formed aperture 45 formed in the rotor 40 to a radial outer surface 44 of the rotor 40. The fluid passageway 46 provides a flow path between the crank chamber 30 and the fluid passageway formed in the drive shaft 32. The fluid passageways 46, 39, 41, 43 cooperate form a flow path between the crank chamber 30 and the suction chamber 20.

A thrust bearing 48 is mounted in the crank chamber 30 on an inner wall 49 of the crankcase 28 and is disposed between the crankcase 28 and the rotor 40. The thrust bearing 48 provides a bearing surface for the rotor 40. An arm 50 extends laterally outwardly from a surface of the rotor 40 opposite the surface of the rotor 40 that contacts the thrust bearing 48. A slot (not shown) is formed adjacent a distal end 51 of the arm 50. A pin 52 has a first end (not shown) slidingly disposed in the slot of the arm 50 of the rotor 40.

A swash plate assembly 53 includes a hub 54 and an annular plate 56. As is known in the art, the hub 54 and annular plate 56 may be formed separately or as an integral piece. The hub 54 includes a hollow, cylindrical main body 58 having a central aperture 59 that receives the drive shaft 32. The annular plate 56 has a pair of opposed, substantially flat surfaces 68 and a central aperture 70 formed therein. The main body 58 of the hub 54 is received in the aperture 70 of the annular plate 56 to form the swash plate assembly 53. An arm 60 extends laterally and radially outwardly from the main body 58. An aperture 64 that receives a second end (not shown) of the pin 52 is formed adjacent a distal end 62 of the arm 60.

A coil spring 72 is disposed around the radial outer surface 38 of the drive shaft 32. A first end 74 of the spring 72 abuts the rotor 40 and a spaced apart second end 76 of the spring 72 abuts the hub 54.

A piston 82 is slidably disposed in each of the cylinders 14 in the cylinder block 12. Each of the pistons 82 includes a head 84 and a skirt portion 86 that terminates in a bridge portion 88.

A pair of concave shoe pockets 90 is formed in the bridge portion 88 of each piston 82 for receiving a pair of semi-spherical shoes 92.

Operation of the compressor 10 is accomplished by rotation of the drive shaft 32 about an axis of rotation X-X. The rotation is caused by an auxiliary drive means (not shown) such as an internal combustion engine of a vehicle, for example. Rotation of the drive shaft 32 causes a corresponding rotation of the rotor 40. The swash plate assembly 53 is connected to the rotor 40 by a hinge mechanism formed by the pin 52 slidingly disposed in the slot of the arm 50 of the rotor 40, and fixedly disposed in the aperture 64 of the arm 60 of the hub 54. As the rotor 40 rotates, the connection made by the pin 52 between the swash plate assembly 53 and the rotor 40 causes the swash plate assembly 53 to rotate. During rotation, the swash plate assembly 53 is disposed at an inclination angle, which may be adjusted as is known in the art. The inclination angle of the swash plate assembly 53, the sliding engagement between the annular plate 56 and the shoes 92, and the rotation of the shoes 92 in the pockets 90 of the bridge portion 88 of the pistons. 82, causes a reciprocation of the pistons 82.

As the pistons 82 reciprocate, the pressure inside the discharge chamber 22 is greater than the pressure inside the crank chamber 30, which is greater than the pressure inside the suction chamber 20. These pressure differences between the discharge chamber 22 the crank chamber 30, and the suction chamber 20 cause a first fluid such as a refrigerant (not shown), for example, and a second fluid (not shown), such as oil, for example to flow into the crank chamber 30, where the two fluids are mixed. The pressure difference between the crank chamber 30 and the suction chamber 20 causes the mixture to flow into the passageway 46 formed in the rotor 40. The seal 47 militates against the flow of fluid directly from the crank chamber 30 into the suction chamber 20. The rotation of the rotor 40 generates a centrifugal force that is exerted upon the mixture. The density of the oil is higher than the density of the refrigerant. The differences in material properties between the refrigerant and the oil and the centrifugal force exerted on the mixture causes a separation of the oil from the refrigerant. Since the oil has a higher density than the refrigerant, the oil is caused to remain in the crank chamber 30, while the refrigerant flows through the passageways 46, 39, 41, 43 to the suction chamber 20.

The amount of centrifugal force exerted on an object is proportional to the distance the object is disposed from the axis of rotation. Accordingly, since the centrifugal force is exerted on the mixture of refrigerant and oil at a larger distance from the axis of rotation X-X than if the mixture were disposed in the drive shaft 32, the amount of centrifugal force exerted on the mixture is maximized.

Once the oil is separated from the refrigerant, additional centrifugal forces exerted upon the oil cause the oil to be distributed from the passageway 46 formed in the rotor 40 back into the crank chamber 30. Accordingly, the amount of oil preserved in the crank chamber 30 of the compressor 10 and the efficiency of the compressor 10 are maximized.

It is understood that other types of compressors, such as a fixed displacement type compressor, for example, can incorporate the oil separation structure described above without departing from the scope and spirit of the invention. In a fixed displacement type compressor that includes a rotary valve, such as disclosed in U.S. Pat. No. 5,372,483, the drive shaft 32 may include a second radially outwardly extending passageway (not shown) formed therein. The second radially outwardly extending passageway is formed between the rotation imparting structure and the end of the drive shaft that includes the rotary valve. The oil separating features described above would be useful in this type of compressor, since the oil would be separated from the refrigerant in the radially outwardly extending passageway formed in the rotation imparting structure before the refrigerant would be introduced into a cylinder.

Figure 2:
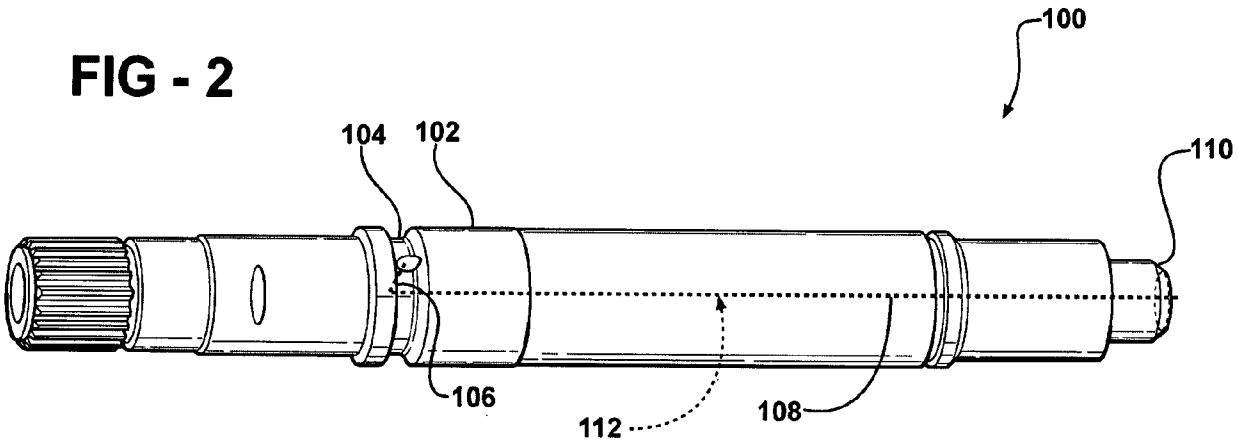
FIG. 2 shows a perspective view of a drive shaft in accordance with another embodiment of the invention.

FIG. 2 shows a drive shaft 100 in accordance with an embodiment of the invention. A radial outer surface 102 of the drive shaft 100 includes a channel 104 formed therein. A fluid passageway 112 is formed in the drive shaft 100. The fluid passageway 112 includes an axially outwardly extending passageway 108 that extends from a distal end 110 of the drive shaft 100 to a radially outwardly extending passageway 106 that extends from the axially outwardly extending passageway 108 to the channel 104. It is understood that additional passageways (not shown) can be formed in the drive shaft 100 as desired, such as an annular array of passageways, for example.

A rotation imparting structure (not shown) such as a rotor or a thrust disc, for example, is mounted to the drive shaft 100 and surrounds the channel 104. A fluid passageway formed in the rotation imparting structure is aligned with and in fluid communication with the channel 104 formed in the drive shaft 100.

In use, the channel 104 formed in the drive shaft 100 facilitates fluid communication between the passageway formed in the rotation imparting structure and fluid passageway 112 formed in the drive shaft 100. The fluid communication is facilitated without a direct angular alignment between the passageway formed in the rotation imparting structure and the radially outwardly extending passageway 106 formed in the drive shaft 100. Use of the drive shaft 100 within the compressor is the same as discussed above for FIG. 1.

Figure 3:
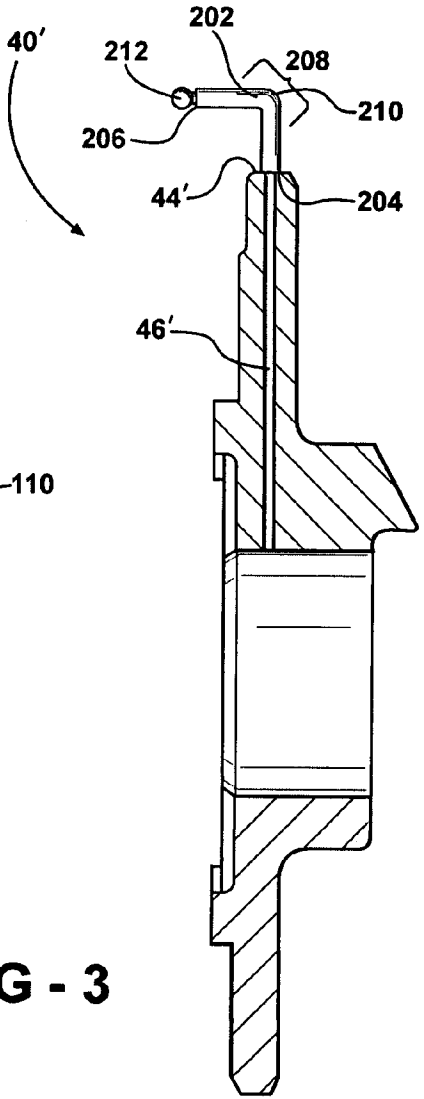
FIG. 3 shows a sectional view of a rotor illustrated in FIG. 1 in accordance with another embodiment of the invention.

FIG. 3 shows the rotor 40' described in FIG. 1 in accordance with another embodiment of the invention. Similar structure to that described above for FIG. 1 repeated herein with respect to FIG. 3 includes the same reference numeral and a prime (') symbol. The rotor 40' includes a fluid passageway 46' formed therein and is mounted on a drive shaft (not shown) in a compressor (not shown) that includes a discharge chamber (not shown), a crank chamber (not shown), and a suction chamber (not shown), as discussed in FIG. 1. A hollow tube 202 is disposed on a radial outer surface 44' of the rotor 40' adjacent the fluid passageway 46'.

A first end 204 of the hollow tube 202 is aligned with the fluid passageway 46' formed in the rotor 40' to provide a flow path between the hollow tube 202 and the passageway 46' formed in the rotor 40'. A second end 206 of the hollow tube 202 is in fluid communication with the crank chamber. In the embodiment shown, an intermediate portion 208 of the hollow tube 202 includes a bend 210 formed therein. The bend 210 can be formed in any direction relative to the rotation of the rotor 40' when in use. Favorable results have been found wherein the bend 201 is formed against the direction of rotation of the rotor 40' when in use.

A porous material 212, such as a filter, for example, is attached to the second end 206 of the hollow tube 202. The porous material 212 shown is in the shape of a sphere. However, other shapes or configurations for the porous material 212 can be used as desired.

Pressure differences between the discharge chamber, the crank chamber, and the suction chamber cause a mixture of a first fluid such as a refrigerant (not shown), for example, and a second fluid such as oil (not shown), for example, to flow into the crank chamber as discussed above for FIG. 1. The pressure difference between the suction chamber and the crank chamber causes the mixture to flow into the hollow tube 202. The rotation of the rotor 40' generates a centrifugal force that is exerted upon the mixture. Differences in material properties between the refrigerant and the oil and the centrifugal force exerted on the mixture causes a separation of the oil from the refrigerant. Since the oil has a higher density than the refrigerant, the oil is caused to remain in the passageway 46', while the refrigerant flows through the passageways formed in the rotor 40' and the drive shaft and into to the suction chamber.

As discussed above, the amount of centrifugal force exerted on the mixture is maximized as a result of the larger distance of the mixture from an axis of rotation.

The hollow tube 202 provides a larger distance from the axis of rotation than the passageway 46' formed in the rotor 40'. Accordingly, a separation of the oil from the refrigerant is maximized.

Once the oil is separated from the refrigerant, additional centrifugal forces exerted upon the oil cause the oil to be distributed from the passageway 46' formed in the rotor 40' back into the crank chamber. Accordingly, the amount of oil preserved in the crank chamber of the compressor is maximized, and the oil can be used to lubricate the internal components of the compressor, thus maximizing the efficiency of the compressor.

The bend 210 formed in the hollow tube 202 creates a more tortuous path for the mixture entering the hollow tube 202 from the crank chamber. Due to its higher density, the amount of oil permitted to flow into the hollow tube 202 is minimized. Accordingly, the amount of oil retained in the crank chamber is maximized.

The porous material 212 militates against the flow of oil into the hollow tube 202 by filtering the oil from the mixture. As the oil is filtered it is collected on the porous material 212. Further, the porous material 212 militates against the flow of contaminates or other undesirable materials that may cause clogging into the hollow tube 202 and the rotor 40'. When the rotor 40' rotates, centrifugal force is exerted on the oil and causes the oil to be detached from the porous material 212. Accordingly, the oil is preserved in the crank chamber, thus maximizing an efficiency of the compressor. It is understood that the porous material 212 can be used without the hollow tube 202, wherein the porous material 212 could be affixed directly to the rotor 40' adjacent the passageway 46'.

Figure 4:
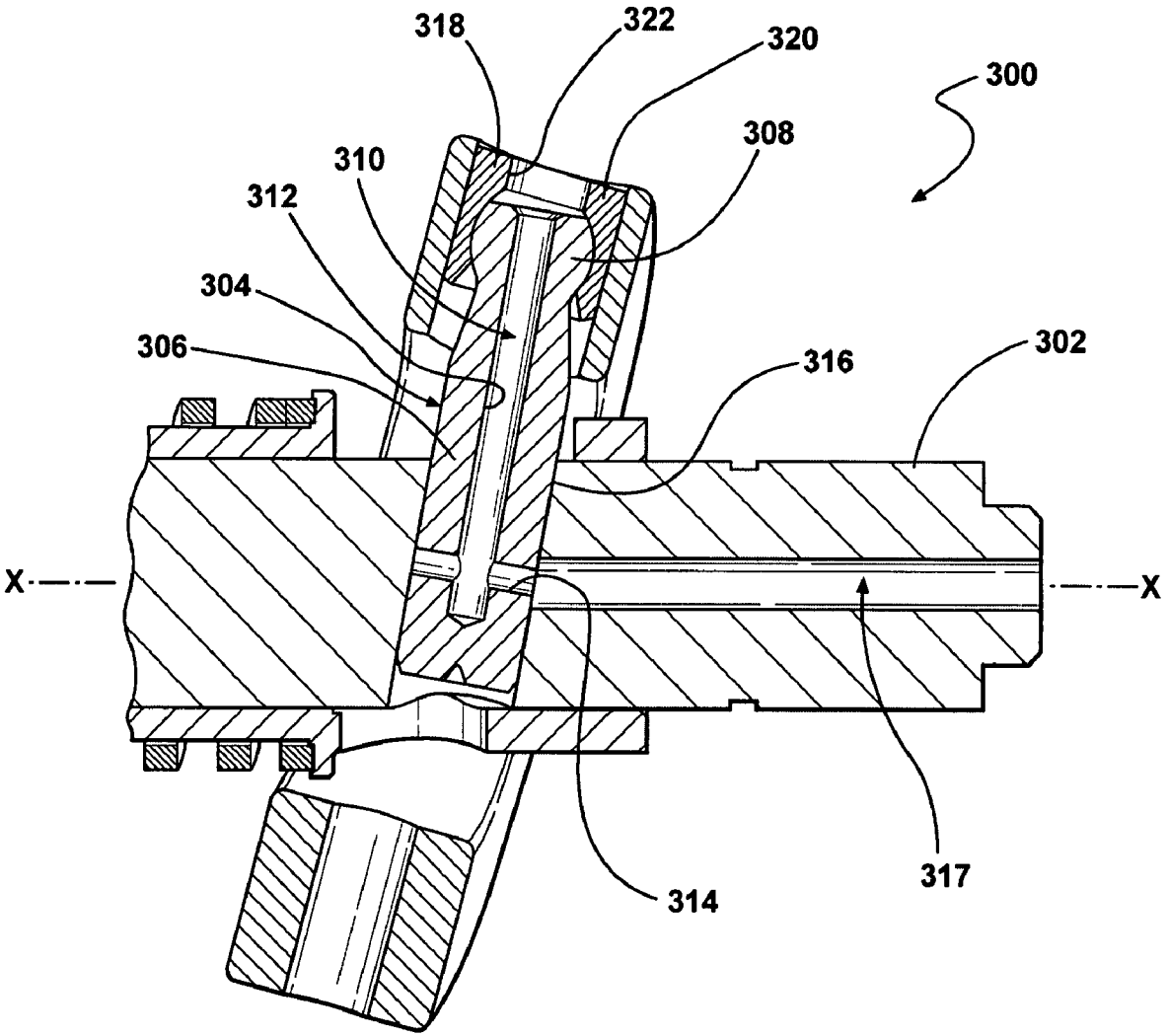
FIG. 4 shows a sectional view of a swash ring and a drive shaft in accordance with another embodiment of the invention.

FIG. 4 shows a swash ring assembly 300 for use in a compressor (not shown), such as a swash ring compressor, for example. In the embodiment shown, the swash ring assembly 300 is formed from bronze and is slidably and pivotally mounted on a drive shaft 302. It is understood that the swash ring assembly 300 can be formed from other materials as desired.

The swash ring assembly 300 and the drive shaft 302 cooperate to house a pin 304. In the embodiment shown, the pin 304 is formed from steel. It is understood that the pin 304 can be formed from other materials as desired. The pin 304 includes a main body portion 306 and a head portion 308. In the embodiment shown, the head portion 308 is formed in the shape of a sphere. A pin having a similar shape is shown in PCT Pat. App. No. WO 2006/024345, herein incorporated by reference in its entity. However, it is understood that the head portion 308 can have other shapes as desired without departing from the scope and spirit of the invention. The pin 304 includes a fluid passageway 310 formed therein. The fluid passageway 310 includes an axially outwardly extending passageway 312 that extends from the head portion 308 into the main body portion 306, and a radially outwardly extending passageway 314 that extends from the axially outwardly extending passageway 312 to a radial outer edge 316 of the pin 304. The radially outwardly extending passageway 314 is substantially aligned with an axially outwardly extending passageway 317 formed in the drive shaft 302, which is in fluid communication with a suction chamber (not shown) of the compressor. It is understood that additional pins (not shown) and/or fluid passageways can be formed in the swash ring assembly 300 as desired.

The head portion 308 of the pin is received by a housing 318 that is housed in the swash ring assembly 300. The housing 318 is preferably formed from steel. It is understood that the housing 318 can be formed from other materials as desired. In the embodiment shown, an inner portion of the housing 318 substantially conforms to the geometry of the head portion 308 of the pin 304. A first end 320 of the housing 318 includes an aperture 322 formed therein. The aperture 322 is substantially aligned with the axially outwardly extending passageway 312 formed in the pin 304.

Operation of the compressor is accomplished by rotation of the drive shaft 302 about an axis of rotation X-X. The rotation is caused by an auxiliary drive means (not shown) such as an internal combustion engine of a vehicle, for example. Rotation of the drive shaft 302 causes a corresponding rotation of the swash ring assembly 300. During rotation, the swash ring assembly 300 is disposed at an inclination angle, which may be adjusted as is known in the art. As the inclination angle of the swash ring assembly 300 is adjusted, the head portion 308 of the pin 304 pivots inside the housing 320. Accordingly, alignment between the radially outwardly extending passageway 314 formed in the pin 304 and the axially outwardly extending passageway 317 formed in the drive shaft 302 is maintained.

The inclination angle of the swash ring assembly 300 causes a reciprocation of a plurality of pistons (not shown). As the pistons reciprocate, pressure differences between a discharge chamber (not shown), a crank chamber (not shown), and the suction chamber cause a first fluid such as a refrigerant (not shown), for example, and a second fluid (not shown), such as oil, for example, to flow into the crank chamber, where the two fluids are mixed. As discussed above for FIG. 1, the pressure difference between the crank chamber and the suction chamber causes the mixture to flow into the passageway 310 formed in the pin 304. The rotation of the rotor swash ring assembly 300 generates a centrifugal force that is exerted upon the mixture. Differences in material properties between the refrigerant and the oil and the centrifugal force exerted on the mixture causes a separation of the oil from the refrigerant. Since the oil has a higher density than the refrigerant, the oil is caused to remain in the passageway 310, while the refrigerant flows through the passageways 312, 314, 317 to the suction chamber.

As discussed above for FIG. 1, the amount of centrifugal force exerted on an object is proportional to the distance the object is disposed from the axis of rotation. Accordingly, since the centrifugal force is exerted on the mixture of refrigerant and oil at a larger distance from the axis of rotation X-X than if the mixture were disposed in the drive shaft 302, the amount of centrifugal force exerted on the mixture is maximized.

Once the oil is separated from the refrigerant, additional centrifugal forces exerted upon the oil causes the oil to be distributed from the passageway 310 formed in the pin 304 back into the crank chamber. Accordingly, the amount of oil preserved in the crank chamber of the compressor and the efficiency of the compressor are maximized.

It is understood that other types of compressors, such as a fixed displacement type compressor, for example, can incorporate the oil separation structure described above without departing from the scope and spirit of the invention.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. An oil separator for a compressor comprising:

a drive shaft including a passageway formed therein and a channel formed thereon, the passageway in communication with a suction chamber of the compressor; and a rotation imparting structure disposed on the drive shaft having a passageway formed therein, the passageway in communication with a crank chamber of the compressor and with the passageway formed in the drive shaft to provide fluid communication between the crank chamber of the compressor and the suction chamber of the compressor, wherein the channel of the drive shaft facilitates fluid communication between the passageway formed in the drive shaft and the passageway formed in the rotation imparting structure.

2. The oil separator defined in claim 1, wherein the rotation imparting structure is a rotor.

3. The oil separator defined in claim 1, wherein the passageway formed in the drive shaft includes a radially outwardly extending passageway and an axially outwardly extending passageway.

4. The oil separator defined in claim 1, further comprising a seal disposed on the drive shaft between the crank chamber and the suction chamber, wherein the seal militates against the flow of fluid directly between the crank chamber of the compressor and the suction chamber of the compressor.

5. The oil separator defined in claim 1, further comprising a hollow tube disposed on the rotation imparting structure, the hollow tube having a first end and a spaced apart second end, wherein the first end of the hollow tube is in communication with the passageway formed in the rotation imparting structure and the second end of the hollow tube is in fluid communication with the crank chamber of the compressor.

6. The oil separator defined in claim 5, wherein the hollow tube includes a bend formed therein.

7. The oil separator defined in claim 5, further comprising a porous material disposed at the second end of the tube.

8. The oil separator defined in claim 1, further comprising a porous material disposed between the passageway formed in the rotation imparting structure and the crank chamber.

9. A compressor comprising:

a head including a suction chamber formed therein;

a crank case including a crank chamber formed therein;

a cylinder block disposed between the head and the crank case, the cylinder block having a plurality of pistons reciprocatingly disposed therein;

a drive shaft rotatingly disposed in the crank chamber and having a passageway formed therein and a channel formed thereon, the passageway in fluid communication with the suction chamber; and a rotation imparting structure disposed on the drive shaft and having a passageway formed therein, the passageway in fluid communication with the crank chamber and with the passageway formed in the drive shaft to provide fluid communication between the crank chamber and the suction chamber, wherein the channel formed on the drive shaft facilitates fluid communication between the passageway formed in the drive shaft and the passageway formed in the rotation imparting structure.

10. The compressor defined in claim 9, wherein the rotation imparting structure is a rotor.

11. The compressor defined in claim 9, further comprising a hollow tube disposed on the rotation imparting structure, the hollow tube having a first end and a spaced apart second end, wherein the first end of the hollow tube is in communication with the passageway formed in the rotation imparting structure and the second end of the hollow tube is in fluid communication with the crank chamber.

12. The compressor defined in claim 11, wherein the hollow tube includes a bend formed therein.

13. The compressor defined in claim 9, further comprising a seal disposed on the drive shaft between the crank chamber and the suction chamber, wherein the seal militates against the flow of fluid directly between the crank chamber and the suction chamber.

14. The compressor defined in claim 9, further comprising a porous material disposed between the passageway formed in the rotation imparting structure and the crank chamber.

15. A method for separating a lubricant from a refrigerant in a compressor comprising the steps of:

providing a drive shaft adapted to be disposed in a crank chamber of the compressor, the drive shaft having a passageway formed therein and a channel formed thereon, the passageway in fluid communication with a suction chamber of the compressor;

providing a rotation imparting structure adapted to be disposed on the drive shaft and having a passageway formed therein, the passageway in fluid communication with a crank chamber of the compressor and with the passageway formed in the drive shaft to provide fluid communication between the crank chamber and the suction chamber, wherein the channel of the drive shaft facilitates fluid communication between the passageway formed in the drive shaft and the passageway formed in the rotation imparting structure;

causing a mixture of a lubricant and a refrigerant to enter the passageway formed in the rotation imparting structure; and causing the drive shaft and the rotation imparting structure to rotate about an axis of rotation to cause a separation of the mixture of fluid by a centrifugal force.

16. The method according to claim 15 further comprising the steps of disposing a hollow tube on the rotation imparting structure, wherein the hollow tube has a first end and a spaced apart second end, wherein the first end is in fluid communication with the passageway formed in the rotation imparting structure and the second end is in fluid communication with the crank chamber of the compressor.

17. The method according to claim 16, further comprising the steps of disposing a seal on the drive shaft between the crank chamber and the suction chamber, wherein the seal militates against the flow of fluid directly between the crank chamber and the suction chamber.

* * * * *